United States Patent [19]

Starai et al.

[11] 4,278,957

[45] Jul. 14, 1981

[54] UHF FILTER ASSEMBLY

[75] Inventors: Terrence M. Starai, Bensenville; John H. Champlin, Jr., Hoffman Estates; Randall J. Johnson, Bloomingdale, all of Ill.

[73] Assignee: Motorola, Inc., Schaumburg, Ill.

[21] Appl. No.: 58,059

[22] Filed: Jul. 16, 1979

[51] Int. Cl.[3] ..... H01P 1/201; H01P 7/00

[52] U.S. Cl. ..... 333/202; 333/33; 333/223

[58] Field of Search ..... 333/202–208, 333/209–226, 185, 245, 248, 33–35; 334/41–45, 85; 361/390–391, 399, 415, 422, 424

[56] References Cited

U.S. PATENT DOCUMENTS

| | | | |
|---|---|---|---|
| 3,538,466 | 11/1970 | Brand | 334/85 X |
| 4,034,319 | 7/1977 | Olsson | 333/203 |

*Primary Examiner*—Marvin L. Nussbaum

*Attorney, Agent, or Firm*—Sang Ki Lee; James W. Gillman; Edward M. Rooney

[57] ABSTRACT

A filter assembly for UHF or microwave frequency range includes a bottom cover plate, a top cover plate and an unitary cast multicell frame with each cell having a resonating rod integrally cast with the frame. Selected ones of the rod have taps which have been cast as integral parts of the single integrally cast multicell. Each tap may include a web cast as an integral part of the unitary cast frame, the webs being dimensioned to adjust the impedance ratio of RF energy coupled to the corresponding cell. The exterior of the top cover plate may have recesses adapted to receive circuit boards therein so that the taps to the resonating rods extending through the frame can be directly connected to the terminal of the circuit boards to eliminate cables to the circuits from the taps.

7 Claims, 1 Drawing Figure

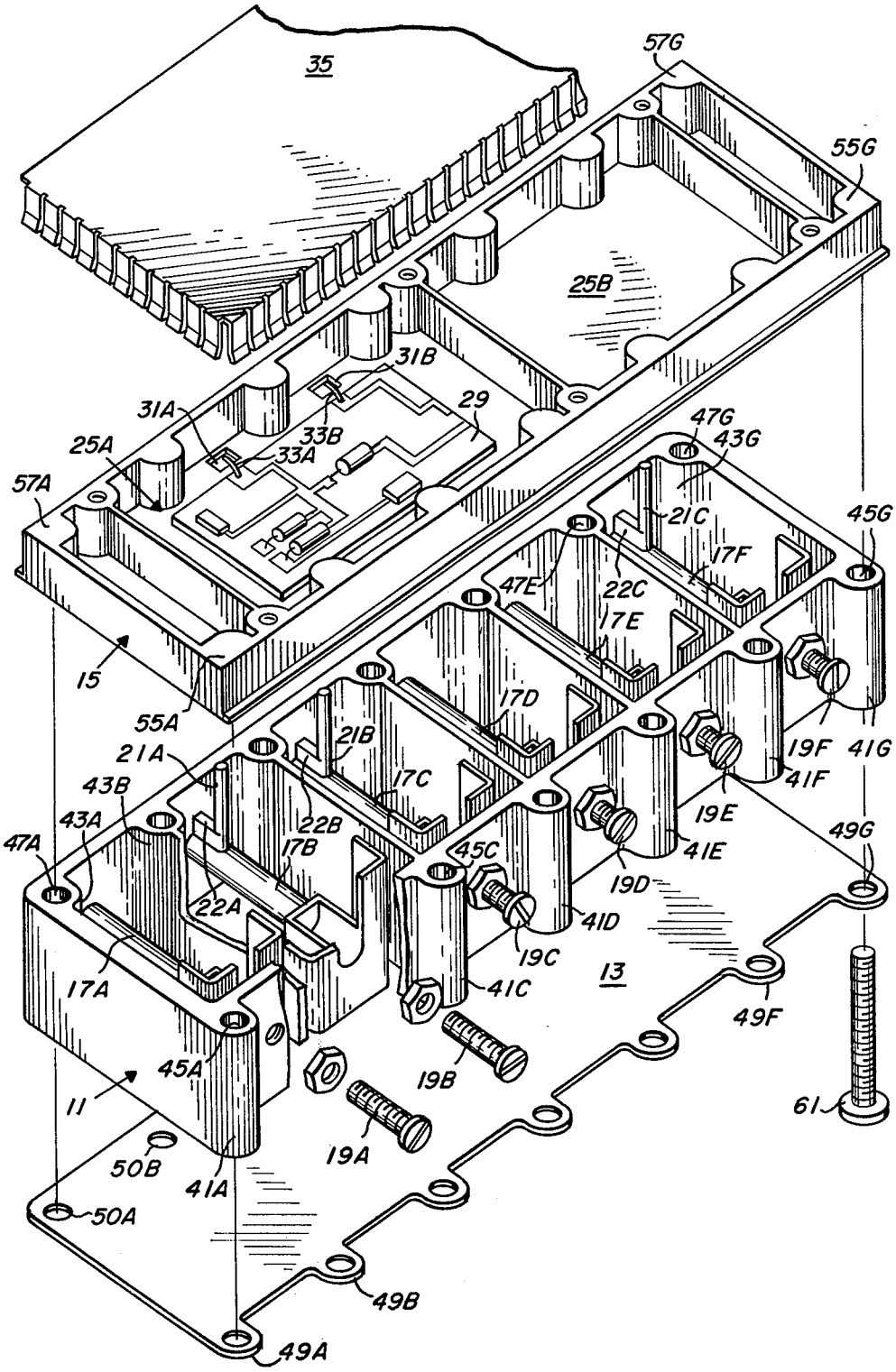
35
57G
55G
25B
31B
29
31A
33B
33A
25A
57A
47G
43G
21C
45G
17F
47E
22C
17E
15
55A
17D
21B
21A
17C
19F
41G
41F
43B
43A
22B
17B
19E
41E
47A
45C
49G
19D
22A
41D
19C
17A
41C
13
49F
45A
19B
11
61
50B
19A
41A
50A
49B
49A

UHF FILTER ASSEMBLY

FIELD OF INVENTION

This invention relates to a filter assembly and in particular an improved filter assembly adapted for use in UHF or microwave frequency range.

A filter for UHF or microwave frequency range usually includes a multicell frame with bottom and top cover plates enclosing the cell formed by a multicell frame. Heretofore it has been the practice to form the multicell frame by fastening together a number of separate pieces in several steps. Thus, for example, in making a multicell frame, according to the prior art, a unitary cast multicell frame without resonating rods is made first, and then a resonating rod is fastened or welded onto the frame at the intermediate position in each of the cells. A tuning screw is then coupled to each of the resonating rods through the frame for providing fine tuning of the filters. Usually the bottom and top cover plates are then fastened to the frame using suitable fastening devices such as screws in separate steps using separate sets of the devices. Also, the plates are usually the planar types with the openings at appropriate locations for allowing taps coupled to the resonating rods to pass therethrough for electrical connections to circuitry such as mixers and amplifiers. Usually, heretofore the external circuitry of different types are connected to and the taps of the resonating rods by conductor wires or cables. Also, separate steps are used often to drill the holes or apertures in the frame.

There are a number of problems and shortcomings associated with the prior art filter. The fact that a separate resonating rod has to be welded or fastened onto each of the cells of the frame means that it not only requires separate steps but also makes it difficult to provide critical adjustment and alignment of the rods relative to the frame. As it is generally known, such an adjustment is very critical but is required to line up the cells properly so that they have proper coaxial alignment. Heretofor, rather elaborate steps and tools have been required to make the fine adjustment necessary to the dimension and the position and to maintain resonating rods at the correct positions in the cells to provide the proper coaxial alignment required in UHF filter operation.

With the use of separate resonating rods, it is difficult to maintain physical integrity, consistency and uniformity among the cells. This has affected adversely the coaxial alignment of the cells of the assembly. Also, they require conductive wires or cables between the taps of the resonating rods and external circuitry.

SUMMARY OF THE INVENTION

It is an object of the present invention to provide an improved UHF filter assembly in general and in particular an improved filter assembly for UHF or microwave frequency range which solves the aforementioned problems and overcomes the aforementioned shortcomings.

In accordance with the present invention, the aforementioned object is obtained by providing a filter assembly for UHF or microwave frequency range that includes a unitary cast multicell frame, each cell including a resonating rod which has been cast as an integral part of the frame. Since the resonating rods are integral parts of the frame and cast at the same time, there no longer is a need for welding or fastening separate resonating rods to the frame in separate steps nor is there a concern for positioning or aligning the rods in the cells. Tight clearance and uniformity required of the cells are provided in a single casting operation. So, assembling operation is substantially simplified.

A feature of the present invention is that selected ones of the resonating rods have taps which have been cast as an integral part of the multicell frame. The taps may include webs that have been cast as the integral part of the multicell frame also, wherein the webs are dimensioned to adjust the impedance ratio of RF energy coupled to the cell.

Yet another feature of the present invention is that the unitary cast multicell frame is so dimensioned and structured as to permit uniform plating of the cells.

Still another feature of the present invention is that the exterior of the top cover plate of the assembly is provided with recesses for receiving circuit boards such as ceramic circuit boards therein and shielding cover is used to cover and shield the circuits within the recesses.

Yet still another feature of the present invention is that the top cover plate has openings aligned to provide connecting passageways to selected ones of the taps, and the taps extend through the openings to reach the terminals of the circuit boards selectively so that the taps can be directly connected to the terminals. This eliminates the need for conductor cables between the taps and the circuits.

Yet another feature of the present invention is that the bottom cover plate is provided with a plurality of holes, the unitary cast frame is provided with a plurality of tubular ribs and the top plate is provided with a plurality of threaded recesses the holes, the tubular ribs and the threaded recesses are aligned so that each of the fasteners fastens and holds the top and the bottom cover plates to the frame.

The foregoing and other features of the present invention will become clearer from the following detailed description of an illustrative embodiment of the present invention in conjunction with accompanying drawings.

BRIEF DESCRIPTION OF DRAWINGS

Accompanying drawing shows a partially broken exploded perspective view of the filter assembly in accordance with the present invention.

DETAILED DESCRIPTION

Generally referring to drawing, the filter assembly in accordance with the present invention includes a multicell frame 11, a bottom cover plate 13, and a top cover plate 15. The multicell frame is of a suitable material such as zinc or brass die cast housing and includes resonating rods, 17A, 17B–17F, cast integrally with the die cast housing. Each of the rods has holes or apertures along the axis thereof for receiving tuning screws therethrough. According to the prior art, the resonators and tuning screw holes have been made in separate steps. This increased the total tolerance to build up and make it very cumbersome to align and adjust the positions and dimensions of the resonators and tuning screws, 19A, 19B–19F. According to the present invention, taps 21A, 21B, 21C to selected ones of the resonating rods required for connecting the resonating rods to the external circuitry are also cast as integral parts of the resonating rod and the frame. The integrally cast resonating rods and taps allow consistent easy and reliable control of the locations of the taps and resonating rods. The taps 21A, 21B, 21C include webs 22A, 22B, 22C that have been cast as parts of the unitary cast frame. The webs are dimensioned to adjust the impedance transformation ratio.

The top cover 15, as illustrated in the present FIGURE, is more than just a planar cover plate. It is also a die cast member made of zinc which has recesses 25A and 25B in the exterior part of the top cover 15. The recesses serve as a part of the housing for the circuits, such as multiplexer, mixer and RF preamplifier circuits which may be in the form of ceramic strip line circuits 29. The top cover plate is provided with apertures 31A, 31B, etc. aligned to permit corresponding taps 21A, 21B, to pass therethrough when the top cover plate 15 is placed to cover the multicell frame. Terminals 33A, 33B of the circuit board can be directly soldered onto the tips of the taps 21A, 21B. This eliminates the need for any conductor cables to connect the taps to the circuit boards. The top cover plate 15 is further provided with a snap-on shield cover 35, which can be used to shield and cover the external circuitry 29 disposed in the recesses of the top cover plate. The bottom plate 13 is a simple flat plate that cover up the open bottom side of the main frame.

Going back to the main frame, there are provided the tubular webs 41A, 41B–41G and 43A, 43B–43G which are provided with axial holes 45A, 45B–45G and 47A, 47B–47G. The webs and holes are cast as an integral part of the frame 11 as the frame is cast. The bottom plate 13 is also provided with holes 49A, 49B–49G, 50A, 50B–50G which are aligned with the holes in the ribs of the frame 11. In a similar manner, the top cover plate includes a plurality of web-like members 55A, 55B–55G and 57A, 57B–57G with partially drilled holes with the drilled portion facing the frame 11 so that when the frame top cover plate is placed on the frame in position, the partially drilled holes of the top cover plate 11 are aligned with the openings of the ribs of the frame 11. As shown in the exploded view, the holes in the bottom plate 13 and the holes of the ribs in the multicell frame 11 and the partially drilled holes of the top cover plate 15 are all aligned in such a way that a single screw 61 can be inserted through each set of aligned holes 49A, 41A, 55A; 49B, 41B, 55B; etc. and then screwed to fasten the top and the bottom cover plate on to the multicell frame 11. This eliminates the need for separate sets of screws for fastening the top cover plate to the frame and then the bottom cover plate to the frame.

Note that the main multicell frame is open on two sides. As a result, the multicell frame can be easily cast in a single step. In a specific application, the frame was zinc-die cast, copper plated and finish-plated with suitable material such as commercially available Albaloy TM without any special tools. The filter assembly as described hereinabove provides the following advantages because of their simplicity in design and the elimination of the need for many separate parts by providing a unitary multicell frame with the integrally cast resonating rods, some of which are provided with taps which are also integrally cast with the frame. The dimensional tolerances of the cells and the resonating rods are easily and tightly controlled by single unitary die casting operation instead of having separate resonating rods fastened onto or welded to the frame as is the case in the prior art. This makes it possible to assemble a filter with a tight coaxial alignment. This is made possible by casting the resonator rod and the tuning screw locations as an integral part of the multicell frame 11 casting operation. The single unitary casting provides accurate and tight control on spatial integrity of the cast elements such as resonating rods and the tuning screw openings.

The unitary single casting of the resonating rods and taps and the tuning screw locations reduce mechanical assembly cost and time very substantially and eliminates the need for elaborate aligning and measuring devices and instruments. Moreover, resonating rods cast integrally with the frame assures uniform cell loading of the multicell assembly at a substantially reduced cost. The casting of the resonating rods, the taps and tuning screw holes in one casting step insures more uniform plating of the cells which is very critical in the filters of this type for UHF and microwave frequency region.

Close proximity of the external circuits permitted in accordance with the present assembly by having the taps directly connected to the terminals of the external circuitry such as printed circuit boards permits the elimination of conductive cables. This improves the circuit performance of the filter.

Hereinabove a filter assembly of the present invention which is especially adapted for UHF or microwave frequency range is described with reference to a particular illustrative embodiment that includes a bottom and a top cover plate and a unitary cast multicell frame disposed between the bottom and top cover plates, the frame having a resonating rod in each of the cells that has been cast as an integral part of the unitary cast multicell frame. Hereinabove is also described other specific features of the present filter assembly which render the present filter assembly substantially superior over the prior art filter assembly and which overcome the various aforementioned problems and shortcomings. It is to be understood that various modifications and changes may be made without departing from the spirit and scope of the present invention.

We claim:

1. A filter assembly for UHF or microwave frequency range comprising:

a bottom cover plate, a top cover plate, and a unitary cast multicell frame disposed between the bottom and the top cover plate, having a resonating rod in each of the cells that has been cast as an integral part of the unitary cast multicell frame, and wherein selected ones of the resonating rods have taps which have been cast as parts of the unitary cast multicell frame, and wherein selected ones of the resonating rods have taps which have been cast as parts of the unitary cast multicell frame.

2. The filter according to claim 1, wherein the taps include webs that have been cast as parts of the unitary cast frame, the webs being dimensioned to adjust the impedance transformation ratio.

3. The filter according to claim 1 or 2, wherein the unitary multicell frame is structured and dimensioned to permit uniform plating.

4. The filter according to 1 or 2, wherein the exterior of said top cover plate has recesses adapted to receive circuit boards therein and said filter includes a shielding cover to cover and shield the circuits within the recesses.

5. The filter according to claim 4, wherein said frame and said top cover plate have openings aligned to provide passageways to selected ones of the taps, said taps extending through the openings to reach terminals of the circuits selectively, whereby the taps can be directly connected to the terminals for eliminating the need for conductor cable connection between the taps and the circuits.

6. The filter according to claim 5, said bottom plate having a plurality of holes, said unitary cast multicell frame including a plurality of tubular ribs, the top plate having a plurality of threaded recesses, wherein said holes, tubular ribs and threaded recesses are aligned so that each of the threaded fasteners fastens and holds the top and the bottom cover plates to the frame.

7. The filter according to claim 6, including screws deposed through the frame and aligned in proximity with the axes of the resonating rods for fine tuning the cells.

* * * * *